United States Patent [19]

Priefert

[11] Patent Number: 4,632,063

[45] Date of Patent: Dec. 30, 1986

[54] ANIMAL HOLDING GATE WITH AUTOMATIC CLOSING OPERATION

[75] Inventor: William D. Priefert, Mt. Pleasant, Tex.

[73] Assignee: Priefert Mfg. Co., Inc., Mount Pleasant, Tex.

[21] Appl. No.: 785,614

[22] Filed: Oct. 9, 1985

[51] Int. Cl.[4] ..... A61D 3/00

[52] U.S. Cl. ..... 119/98

[58] Field of Search ..... 119/98, 99, 147 R

[56] References Cited

U.S. PATENT DOCUMENTS 4,027,629 6/1977 Pearson ..... 119/98 X 4,100,886 7/1978 Wade et al. ..... 119/98

4,226,212 10/1980 Priefert ..... 119/98

4,302,908 12/1981 Parker ..... 119/98 X

*Primary Examiner*—Robert P. Swiatek

[57] ABSTRACT

The animal holding gate is operable either manually or automatically to hold an animal. In an automatic operation, a pair of animal engaging members are initially adjusted to positions permitting the head of an animal to pass therethrough and then are automatically operated to continuously move inwardly against opposite sides of an animal's neck and to be releasably locked against outward movement to maintain an animal holding position. The initial gate setting mechanism is in a readily visible position and conveniently accessible for quick and easy manipulation to accommodate in succession animals of varying size.

5 Claims, 9 Drawing Figures

15
22
23
23
32
32
42
61
59
62
63
39
65
66
37
38
36
34
33
35
19
29
16
26
24
31
27
17
18
28
43
41
52
44
48
47
51
49
46
58

ANIMAL HOLDING GATE WITH AUTOMATIC CLOSING OPERATION

BACKGROUND OF THE INVENTION

Animal chute gates are well known for holding cattle substantially immobile for medical treatment or the like. Examples of such gates are shown in U.S. Pat. Nos. 3,623,456 and U.S. Pat. No. 4,226,212. The gate shown in U.S. Pat. No. 4,226,212 has a pair of upright animal engaging members supported on a main frame for manual movement toward and away from an animal engaging position. In addition to being manually operable, the gate can be set for automatic closing, when contacted by an animal, by a trigger mechanism having a vertically rotatable catch means operatively associated with a horizontally movable trigger member. Although the trigger mechanism of the U.S. Pat. No. 4,226,212 is generally satisfactory in operation, difficulty has been encountered in visually setting the mechanism for automatic operation and in releasing the mechanism to permit a quick exit of an animal from the gate.

SUMMARY OF THE INVENTION

The chute gate of this invention has a pair of upright clamping or animal engaging members that are relatively movable into and out of an animal clamping position in response to rotation of a rock shaft. The rock shaft is equipped with a handle member and may be rotated manually or by a spring assembly when the gate is automatically operated. For automatic operation the spring assembly is set to yieldably move the clamping members toward each other, and for a manual operation is set to move the clamping members away from each other. A releasable holding means and a releasable friction locking means for the clamping members are pivotally suspended from the handle on a common pivot for concurrent actuation in response to a rocking movement of the handle in one direction. With the spring assembly set for an automatic operation of the gate the holding means is adjusted to hold the clamping member in a partially open position against movement toward each other to permit the entrance of an animal's head therebetween. In this adjusted position the releasable locking means locks the clamping members against movement away from each other. When the animal moves forwardly against the clamping members, the handle, through an interconnected lever assembly of the clamping members with the rock shaft, is rocked in one direction to release the holding means concurrently with a release of the locking means to provide for the spring assembly moving the clamping members toward each other. The holding means remains released and the locking means is alternately released and locked until the neck of an animal is firmly engaged between the clamping members.

DESCRIPTION OF THE PREFERRED EMBODIMENT

Figure 1:
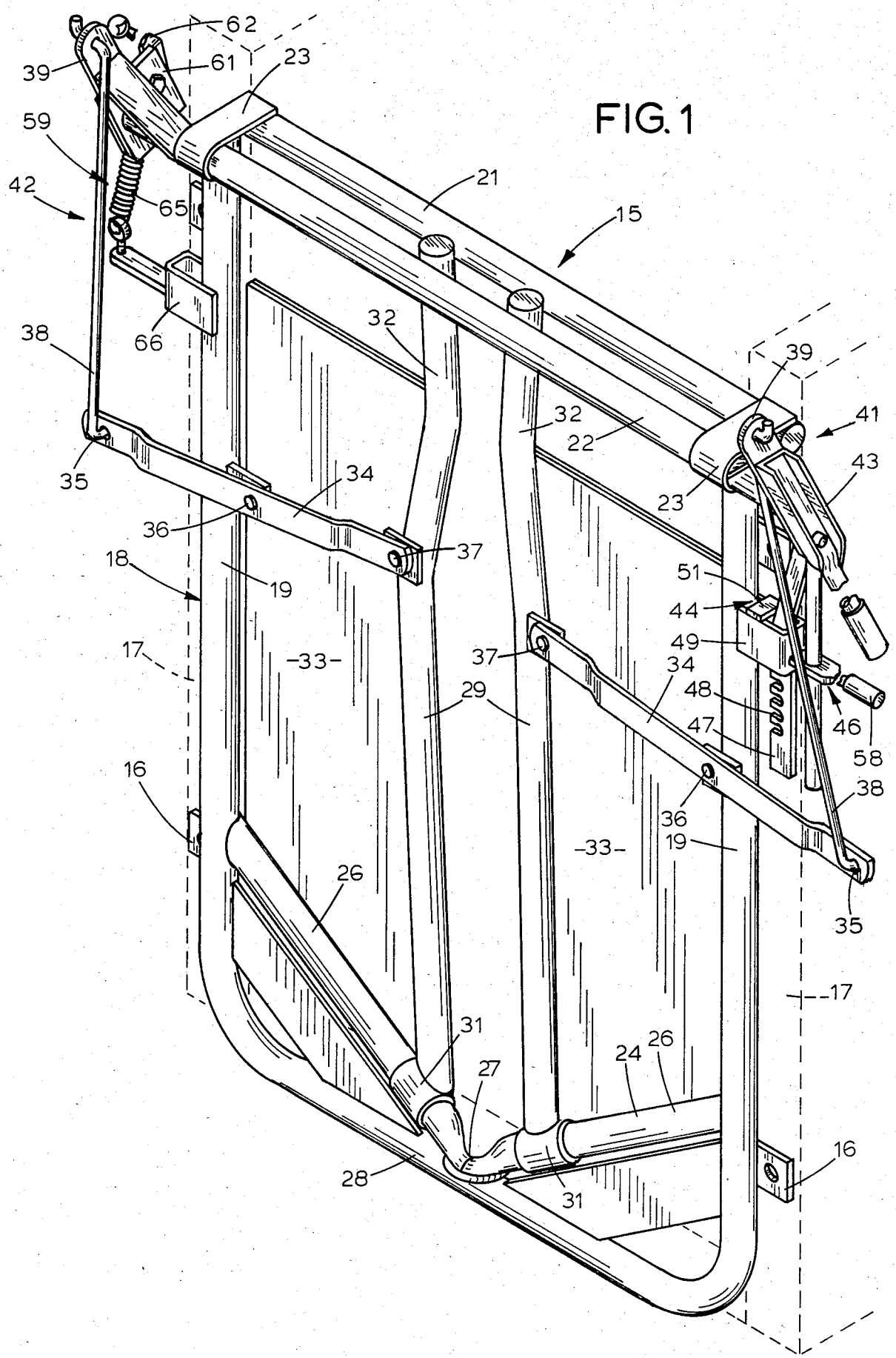
FIG. 1 is a front top perspective view of the chute gate of this invention, conditioned for manual operation, and shown in a closed position.

Referring to FIG. 1 of the drawings, the animal holding gate, shown generally at 15, is operable manually to hold an animal or automatically by contact with the animal to be held. The gate is fixed by mounting brackets 16 on front end posts 17 of a cattle chute (not shown).

The holding gate 15 (FIG. 2) includes an upright U-shaped frame member 18 that has a pair of vertical leg or side members 19 connected together across their upper ends by a connecting bar 21 which extends between the top ends of the side members 19 and is secured to the rear sides thereof as by welding. A rock shaft 22 parallel to and spaced forwardly from the connector bar 21 is rotatably mounted on the side members 19 at positions forwardly thereof on journal members 23. The mounting brackets 16 are also carried on the side members 19 for securement to the chute end posts 17.

Arranged within the plane of the upright frame member 18 and at the lower end thereof is a transverse angulate member 24 of a V-shape having leg sections 26 secured to corresponding upright side members 19 and an apex portion 27 secured to the central portion of the base 28 of the U-shape frame member 18.

A pair of upright animal clamping or engaging members 29 are arranged between the side members 19 and in the plane of the frame member 18. Each of the engaging members 29 has a tubular bearing or sleeve member 31 at the lower end thereof mounted for slidable movement longitudinally of an associated leg section 26. The upper end portions 32 of the engaging members 29 are extendible between and guidably supported within the guideway formed between the connecting bar 21 and the rock shaft 22. This guideway supports the engaging members 29 against fore and aft movement of the gate while permitting relative lateral movement which takes place concurrently with a vertical movement of the engaging members 29 in response to their riding action on the leg sections 26 of the angulate member 24.

Figure 2:
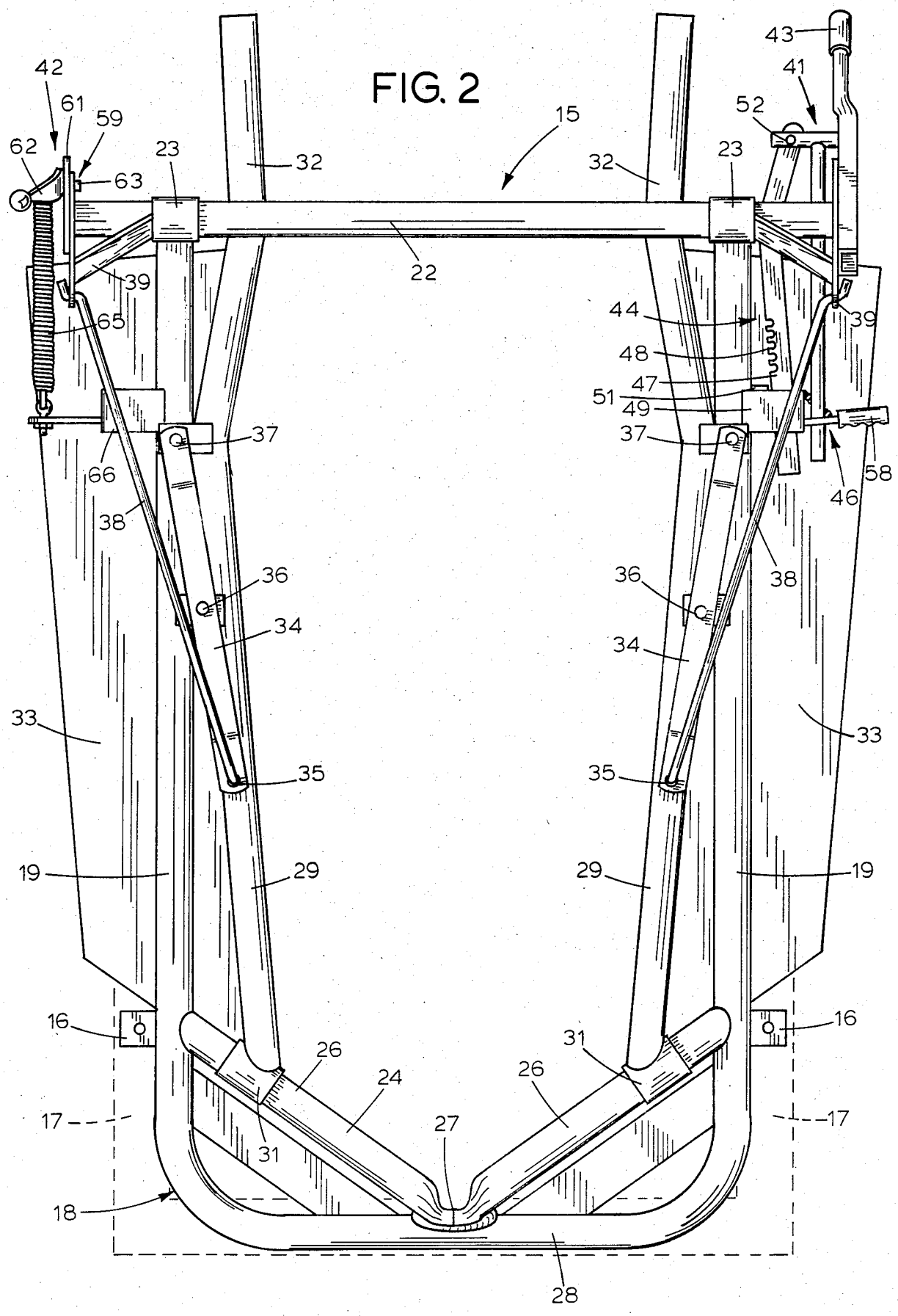
FIG. 2 is a front elevational view of the chute gate illustrated in FIG. 1 and shows the gate in an open position.

When the engaging members 29 have their lower portions adjacent the apex 27 of the angulate member 24, as shown in FIG. 1, the gate 15 is in a closed position. When the members 29, as shown in FIG. 2, are moved to their outermost positions, the holding gate 15 is in its open position wherein an animal is provided free movement through the gate between the members 29 and over the angulate member 24. The upright frame member 18, angulate member 24 and engaging members 29 are all of a tubular pipe construction to reduce to a minimum any possible injury to an animal striking thereagainst.

Each of the engaging members 29 carries an upright closure plate 33 which has one side secured, as by welding, to the rear side of an associated engaging member 29. Each closure plate 33 is movable as a unit with an associated engaging member 29 and functions to block off the space occurring between a side member 19 and engaging member 29 when the gate is in the closed position therefor. On movement of the members 29 to an open gate position the closure plates 33 are movable laterally outwardly from the side members 19 in a contact engagement with the rear sides of such members. The engaging members 29 are movable to their open and closed positions of the gate 15 by corresponding levers 34, each of which is pivoted intermediate its ends at 36 to an adjacent side member 19. Each lever 34 has one end pivoted at 37 to a corresponding engaging member 29 and an opposite end pivotally connected at 35 to the lower end of an upright link 38, the upper end of which is pivotally connected to a forwardly projected rock arm 39 on the rock shaft 22.

Figure 3:
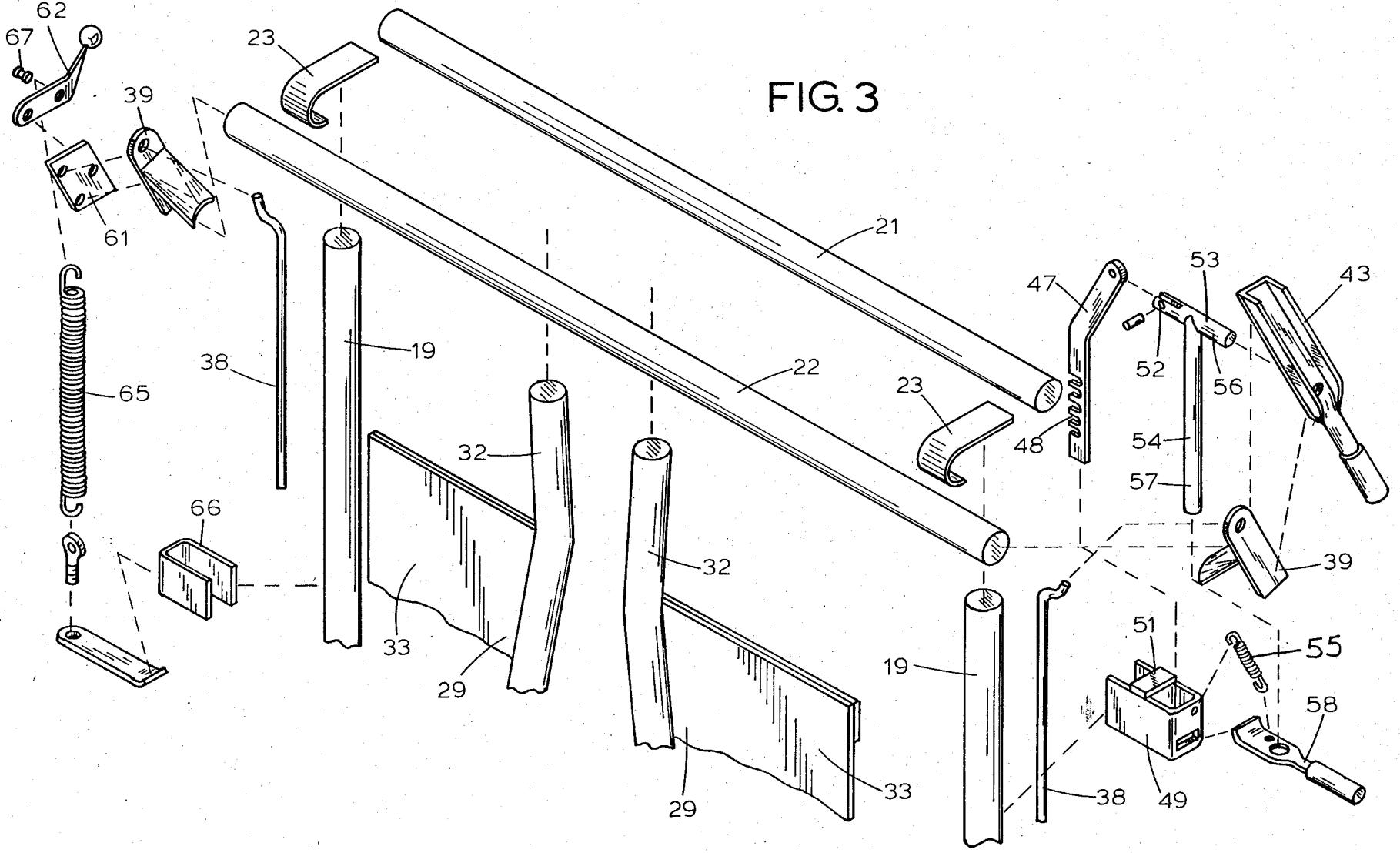
FIG. 3 is an exploded fragmentary front perspective view of the upper portion of the gate in the closed position of FIG. 1.

For the purpose of convenience of description, the right and left hand sides of the gate 15, as shown in FIG. 1, will be hereinafter referred to as the operating side 41 and the shift side 42, respectively. The rock arm 39 (FIGS. 2 and 3) on the operating side of the gate has a medial portion secured to the end of the rock shaft 22 and carries a handle 43 radially extended rearwardly from the rock shaft 22. The engaging members 29 are thus interconnected with the rock shaft 22 by the levers 34, links 38 and rock arms 39 so as to be manually movable by the hand lever 43 between open and closed positions of the gate 15. However the gate 15 is also operated automatically to a closed position by an animal to be held and such operation will now be described.

To provide for an automatic operation of the gate 15, there is provided on the operating side 41 of the gate (FIGS. 1 and 2) a releasable holding mechanism 44 and a friction locking mechanism 46 which are actuated by the handle member 43 and located between handle and the adjacent side member 19 of the frame member 18. The holding mechanism 44 includes an upright latch member 47 of an angulate shape having a notched lower portion 48 extendible through a guide bracket 49 secured to and projected laterally outwardly from the adjacent side member 19. A horizontal catch or ledge member 51 on the bracket 49 is arranged for engagement with one of the notches 50 in the lower portion 48 of the latch member 47.

The upper end of the latch member 47 (FIGS. 3 and 8) is pivoted at 52 to one end of a cross arm 53 of a T-shape member 54. The opposite end 56 of the cross arm 53 is inserted through the operating handle 43 for pivotal support thereon. It is thus seen that the latch member 47 and T-shape member 54 have a common pivotal support on the handle 43 so as to be concurrently movable in up and down directions in response to a rocking movement of the handle about the axis of the rock shaft 22. The stem or slide rod 57 of the T-member 54 coacts with a locking member 58, which is pivoted on the guide bracket 49 to friction locking and release positions relative to the slide rod 57. The locking member 58 is manually retained out of locking engagement with the slide rod to permit adjustment of the latch member 47 into engagement with the catch member 51 at a selected notch 50, and on being released locks the engaging members 29 in the adjusted notch position against movement away from each other.

Figure 8:
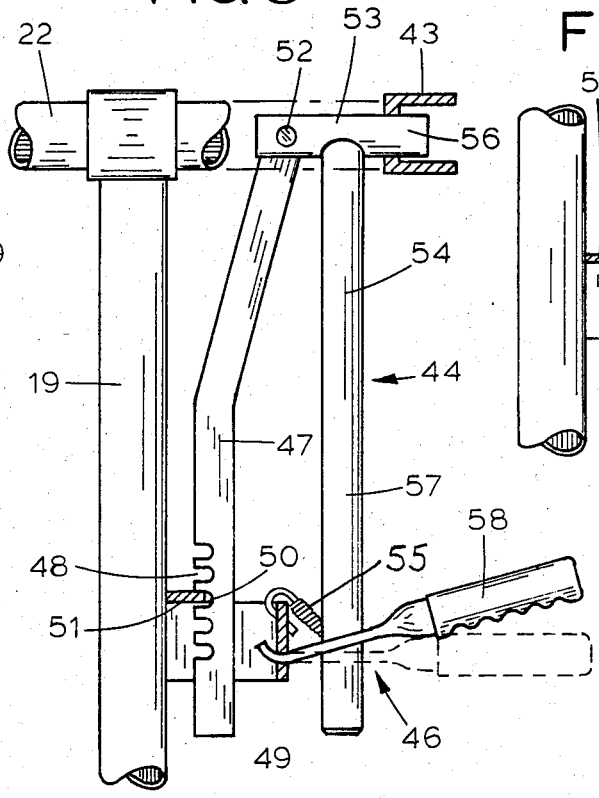
FIG. 8 is a detail front elevational view of the relative assembly of the holding mechanism and the releasably frictional locking mechanism in set positions providing for an automatic operation of the gate.

Referring to FIG. 8, it is seen that the pivot 52 for the latch member 47, by virtue of the angulate shape of the trigger member, is offset laterally of the gate 15 from the latch portion 48 when engaged by the catch member 51 and that in the engaged position the latch portion is in a substantially vertical position. A notch 50 is of a width slightly greater than the thickness of the catch member 51. In the automatic operation of the gate the engaging members 29 are yieldably urged toward each other by a spring assembly 59 on the shift side 42 of the gate whereby the rock shaft is biased in a direction to move the handle 43, and in turn the latch member 47 in a downward direction. The upper side of a notch 50 is thus in contact engagement with the catch member 51 to frictionally hold the latch member 47 against the action of gravity from swinging free of the catch member 51. This holding of the latch member 47 and the frictional locking of the slide rod 54 by the locking member 58 are released on upward rocking movement of the handle 43 in response to an outward movement of the engaging members 29 by an animal entering therebetween.

The toggle spring assembly 59 (FIGS. 2 and 3) has a mounting plate 61 mounted on the rock arm 39. A toggle or shift arm 62 is pivoted at 63 on the mounting bracket 61 adjacent the top side 64 thereof. A coil spring 65 is connected under tension to a clamp 66 on the adjacent side member 19. The pressure of the spring acting on the engaging members 29 is reversible by moving a stop pin 67 on the toggle arm 62 into engagement with the side 64 of the mounting plate to one side or the other of the pivot 63.

The animal to be held in the chute gate 15 may be of varying size and the operator soon becomes familiar with the notch setting of the latch bar 47 to permit an initial entry of the animal between the engaging members 29. Prior to the setting of the latch member 47, the spring 65 on the shift side 42 of the gate 15 is set by the toggle arm 62 to its position shown in FIGS. 4 and 5 providing for the spring acting to move the engaging members toward each other. The spring tension is thus increased progressively with the movement of the members 29 to their full open positions.

Figure 4:
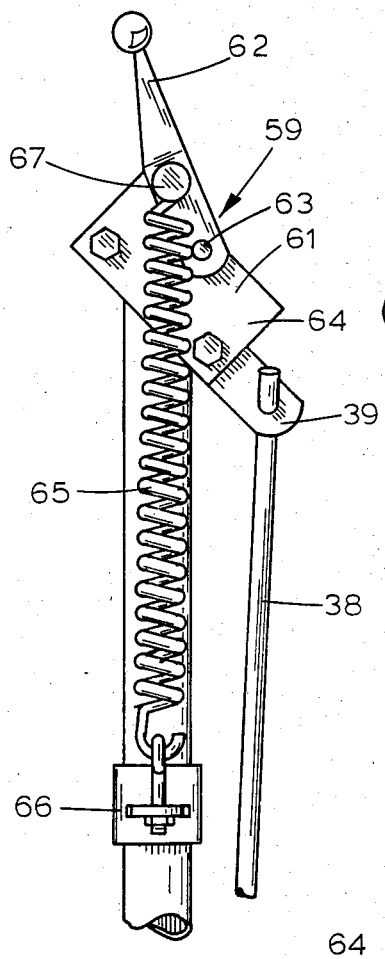
FIG. 4 is an enlarged side elevational view of a spring assembly that forms part of the chute gate showing the relative positions of the parts thereof when the gate is open in the automatic operation thereof.
Figure 5:
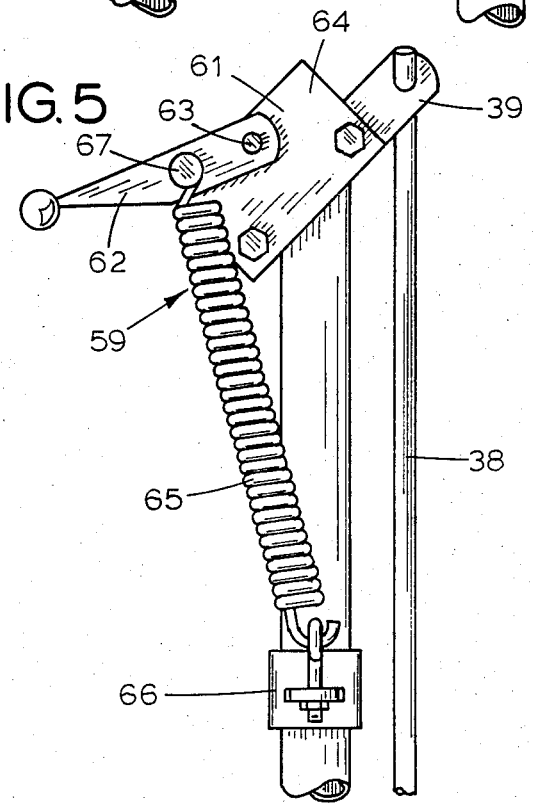
FIG. 5 is illustrated similarly to FIG. 4 and shows changed positions in the spring assembly when the gate is closed in the automatic operation thereof.

The spring 65 is illustrated in FIG. 4,in its fully extended position, when the gate 15 is in a fully open position; and in FIG. 5, in a fully retracted position, when the gate 15 is in its closed position. With the toggle arm 62 set to condition the spring 65 to move the engaging members 29 toward each other to a gate closing position, the latch member 47, through actuation of the handle 43, is adjusted to a selected notch 50 for engagement with the catch member 51, as shown in FIG. 8. This adjustment of the latch member 47 and its retention in an adjusted position takes place with the locking member 58 held in a release position relative to the slide rod 54.

Figure 9:
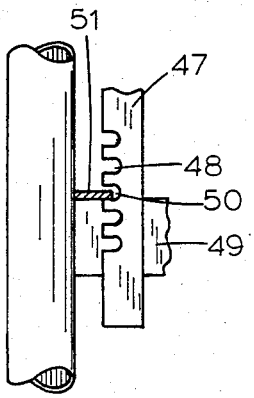
FIG. 9 is illustrated similarly to FIG. 8 and shows the holding mechanism and locking mechanism in their concurrently released positions in response to an animal entering the gate.

With the engaging members 29 opened to a desired position for the entry therebetween of the animal to be held, the animal on entering the gate tends to spread the engaging members apart by forcing its widening neck portion between the engaging members. The movement of the engaging members away from each other is transmitted through the levers 34 to the links 38 which then pull downwardly on the rock arms 39 which in turn rock the rock shaft 22 in a direction to lift the handle 43. This upward rocking movement of the handle 43 lifts the slide rod 57 and latch member 48 whereby the latch member 48 is released from the catch member 51 (FIG. 9) concurrently with the release of the slide rod 57 by the locking member 58. In this respect it is seen that the spring 55 of the friction locking mechanism acts on the locking member 58 to lock the slide rod 57 against downward movement. The latch member 47 under the action of gravity is retained out of engagement with the catch member 51 and the temporary release of the locking member 54 permits the engaging members 29 to close against opposite sides of the animal's neck.

Any continued movements of the animal acting to spread the engaging members 29 apart will provide for alternate release and locking actions by the locking member 58 relative to the slide rod 57 so as to further close the engaging members against the animal's neck. It is seen, therefore, that the gate 15 operates automatically to yieldably move the engaging members inwardly about the neck of an animal to a holding position from an initial animal entry position providing for the head clearance but not the shoulder clearance of the animal between the engaging members. By simply manually holding the locking member 58 to release the slide rod 57 and moving the handle 43 upwardly the animal is quickly released from the gate to provide for the next adjustment of the engaging members 29 to receive and then hold the next following animal.

Figure 6:
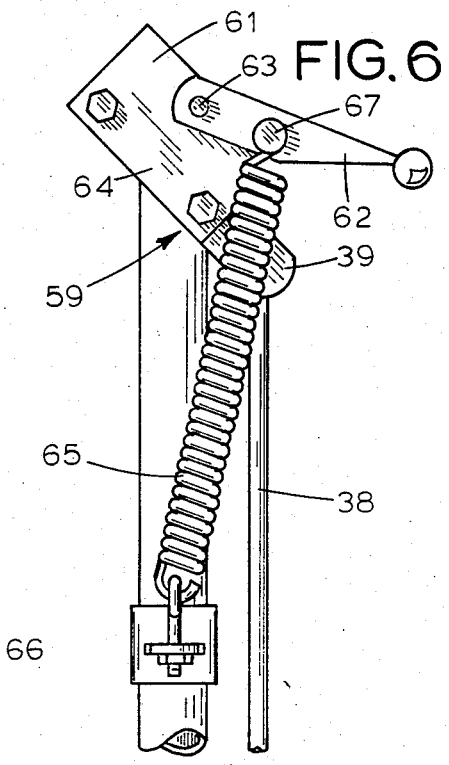
FIG. 6 is an enlarged side elevational view of the spring assembly with the parts shown in their relative positions when the gate is open in the manual operation thereof.
Figure 7:
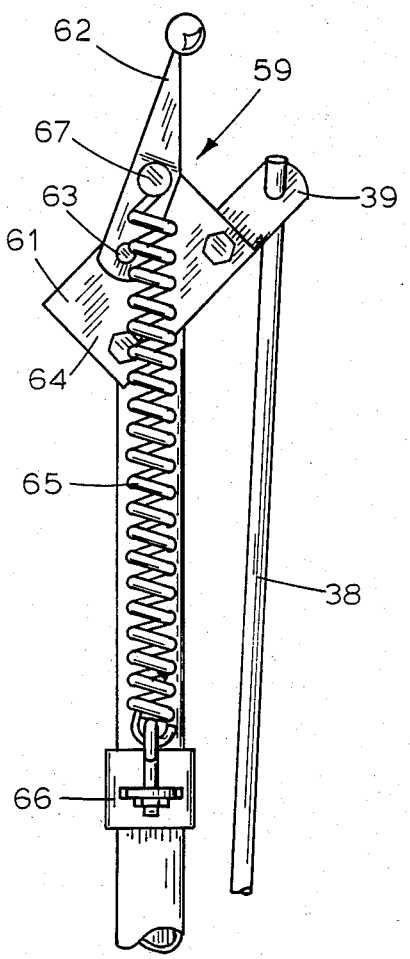
FIG. 7 is illustrated similarly to FIG. 6 and shows changed positions in the spring assembly when the gate is closed in the manual operation thereof.

For a manual operation of the gate, the spring 65 is set into a position acting to continuously open the gate 15. The toggle arm 62 is moved from its position shown in FIGS. 4 and 5 to the position therefor, shown in FIGS. 6 and 7. In FIG. 6, the gate 15 is in a fully open position wherein the spring 65 is in a fully retracted position and in FIG. 7 the spring is shown in its fully extended position corresponding to a fully closed position of the gate 15. With the shift lever or toggle arm 62 thus positioned, the gate is opened and closed in response to the operation of the handle 43 concurrently with a corresponding manipulation of the locking member 58.

During a manual operation of the gate, it is to be understood that the latch member 47 will move freely within the mounting bracket 49 and out of engagement with the catch member 51. The gate is generally manually operated in the handling of horned cattle and automatically operated for polled cattle.

Although the invention has been described with respect to a preferred embodiment thereof, it is to be understood that it is not to be so limited since changes and modifications can be made therein which are within the full intended scope of this invention as defined by the appended claims.

I claim:

1. An animal holding gate comprising:

(a) an upright main frame having a pair of transversely spaced side members, (b) an upright animal engaging member for each of said side members guidably supported on said main frame for movement laterally thereof, (c) a transverse rock shaft rotatably mounted on said frame adjacent the upper ends of said side members for rocking movement in reversed directions, (d) a lever system interconnecting each of said animal engaging members with said rock shaft whereby said animal engaging members are movable laterally relative to each other in response to a rocking movement of the rock shaft, (e) yieldable means for urging said rock shaft in one direction to move the animal engaging members toward each other, (f) means for releasably holding said engaging members in an animal entry position therebetween against movement toward each other, (g) means for releasably locking said animal engaging members against movement away from each other, (h) means for interconnecting said releasable holding means and said releasable locking means with said main frame and rock shaft for concurrent release in response to movement of the rock shaft in an opposite direction, whereby no entry of an animal between said engaging members, said engaging members are urged to transmit through said lever systems a rocking movement to said rock shaft in said opposite direction, (i) said releasable holding means including a rock arm on said rock shaft, a catch member on said frame, and an upright latch member having a series of notches in a side portion thereof, and (j) means pivotally suspending the latch member from the rock arm for lateral movement away from the catch member to a suspended position therefor, (k) said rock arm being manually movable to engage said latch member at a notch therein with said catch member to hold said animal engaging members in said animal entry position.

2. The animal holding gate according to claim 1, wherein: (a) said releasable holding means includes a rock arm rod member pivotally supported on said rock for up and down movement in response to a rocking movement of said rock shaft, and (b) a locking member on said frame frictionally engageable with said rod member on a downward movement of the rod member.

3. The animal holding gate according to claim 2, wherein:

(a) said latch member and rod member are pivotally supported on the rock arm for pivotal movement about a common axis parallel to the axis of said rock shaft, and (b) means for pivotally supporting said latch member on said rod member for pivotal movement relative to said rod member about an axis normal to said common axis.

4. The animal holding gate according to claim 1, wherein:

(a) said latch member, on disengagement from the catch member, is movable by gravity to the suspended position therefor.

5. The animal holding gate according to claim 1, wherein:

(a) said upright latch member is of an angulate shape with said notches arranged in the lower portion thereof so that when the latch member is engaged with said catch member said lower portion is in a substantially vertical position.

* * * * *